US006829967B1

(12) United States Patent
Kemp

(10) Patent No.: US 6,829,967 B1
(45) Date of Patent: Dec. 14, 2004

(54) POWER TONG TOOL

(76) Inventor: Terry L. Kemp, 1760 C.R. 1033, Muleshoe, TX (US) 79347

( * ) Notice: Subject to any disclaimer, the term of this patent is extended or adjusted under 35 U.S.C. 154(b) by 0 days.

(21) Appl. No.: 10/632,601

(22) Filed: Aug. 1, 2003

(51) Int. Cl.[7] ..... B25B 13/50
(52) U.S. Cl. ..... 81/57.15; 81/57.2; 81/57.14
(58) Field of Search ..... 81/57.15, 57.14, 81/57.2, 57.18, 57.3, 57.31, 57.33, 57.43

(56) References Cited

U.S. PATENT DOCUMENTS

| | | | | |
|---|---|---|---|---|
| 3,023,651 A | | 3/1962 | Wallace | |
| 3,140,624 A | | 7/1964 | George | |
| 3,541,897 A | | 11/1970 | Horton | |
| 4,437,363 A | | 3/1984 | Haynes | |
| 4,572,036 A | | 2/1986 | Renfro | |
| 5,000,065 A | * | 3/1991 | Haynes | 81/57.2 |
| 5,044,232 A | | 9/1991 | Schulze-Beckinghausen | |
| 6,327,938 B1 | | 12/2001 | Pietras | |

* cited by examiner

*Primary Examiner*—Debra S. Meislin
(74) *Attorney, Agent, or Firm*—Robert C. Peterson; Milburn & Peterson P.C.

(57) ABSTRACT

A power tong for coupling and uncoupling tubular members including relatively large diameter members and relatively small diameter members whether in a concentric or not configuration, wherein a housing mounts a rotary framework having a U-shaped cavity adapted to receive tubular member coaxially with the rotary framework. The rotary framework pivotally mounts three chordal segments each having a toothed arc and a chordal border spaced about the cavity and having two pair of recesses with adjustable gripping elements seated therein, one pair for coupling and uncoupling relatively large tubular members from a stationary member and the other for coupling and uncoupling relatively small tubular members from a stationary member. The power tong is capable of engaging and uncoupling an outer tubing member, disengaging therefrom and then engaging and uncoupling an inner tubing member of a tubing string without repositioning the power tong, as well as, the reverse process.

15 Claims, 5 Drawing Sheets

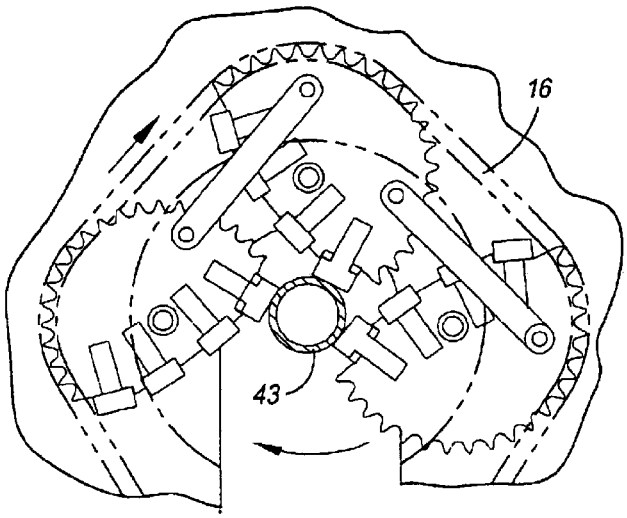
FIG. 7
FIG. 8
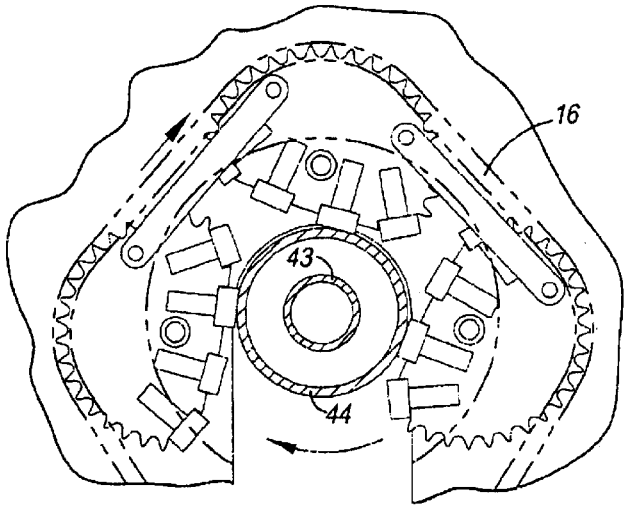
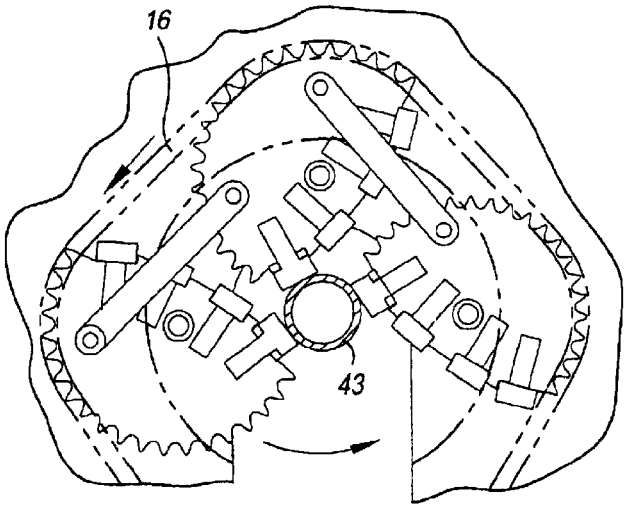
FIG. 9

POWER TONG TOOL

BACKGROUND OF THE INVENTION

1. Field

This invention relates to power tongs for coupling and uncoupling pipes or tubes used for the operation of removing underground fluids to the surface; more particularly, the power tong relates to power tongs for coupling and uncoupling single or multi-concentric pipes or tubing used in the production of underground fluids such as oil and gas and water.

2. State of the Art

Numerous techniques have been developed in the used of power tongs for gripping and rotating links of pipe or tubing sometimes referred to as joints. Generally, power tongs comprise a body or housing, a rotary mechanism mounted in said body to impart rotation at least one active jaw to engage the pipe with other active or passive jaws that sufficiently engage the pipe so that the jaws rotate with the rotary mechanism relative to the body of the power tongs to couple or uncouple one joint from another joint held stationary. Most of the power tongs provide cams to move the active jaws into gripping arrangements with the pipe to be rotated. Once the joints have been coupled or uncoupled, the power tong generally must be disengaged from surrounding the pipe such that the uncoupled joint may be removed or a new joint positioned for coupling to the pipeline string. Various methods of withdrawing the power tong have been proposed by providing a tong such as described in U.S. Pat. No. 3,023,651 to EM Wallace illustrated with two segments being connected to the main segments by pivots. The tong requires a latch to secure the pivotal segments around the pipe to be coupled or uncoupled.

The deficiency in power tongs with only one active jaw, the active jaw must be dismounted and remounted on the opposite side of the rotary requiring a different camming, thus consuming time. In other power tongs, two cam members are provided, which permits rotation in either direction from a neutral position.

Another problem with prior power tongs is the limited range of pipe sizes that can be used in which proper gripping action is achieved without surface damage to the pipe. Other tong arrangements have provided for replacing cam members to meet the requirements of satisfactorily gripping the pipe to avoid damaging the surface.

SUMMARY OF THE INVENTION

The present invention provides a power tong for coupling and uncoupling tubular member including relative large diameters and relative small diameters whether in a concentric or not configuration, wherein a housing or frame support three chordal segments, which are similar to the shape of the moon halfway between the first quarter and fully phases, with the arcs being toothed and the chordal border mounting gripping elements, which may be adjustable by providing spacers behind the gripping elements designed for gripping relatively large pipe and behind gripping elements designed for gripping relatively small pipe. The chordal segments include a master segment linked to slave segments at each side of the master segment. The segments are rotated in one direction for moving the gripping elements into engagement with and uncoupling the pipe, or in the opposite direction for coupling. The chordal segments, mounted between an upper and a lower slotted plates for rotation relative to the housing, are driven by a chain drive, which imparts pivoting of the chordal segments to engage a pipe or tubular member and then rotate the chordal segment, the slotted plates and pipe or tubular member and permits removal of the tool from surrounding the tubing string when the chordal segments, are in the neutral position and aligned with the slotted plates, whereby the power tong may be positioned around a tubing string or removed form the tubing string as necessary.

Further advantages of the present invention include the chordal sections being mounted to a rotary member, which when the gripping elements on the chordal segments engage a tubular member initiates rotation of the rotary mechanism and continues for sufficient revolutions to either uncouple or couple a pipe joint from the rest of a string of pipes being held stationary.

To insure that the chordal segments are in a neutral position when backed off from gripping the pipe, a stop lug or pin is provided mounted on the master segment which engages the linkage between the master segment and the slave segment allowing the rotary mechanism to rotate in the opposite direction to the neutral position.

It is an additional feature of the invention that the gripping elements may be adjusted by spacers to engage different diameters of tubing to afford the same even gripping pressure on the tubing regardless of the diameter. Likewise, the angle of the gripping element faces may be changed by removing one series of gripping elements and replacing them with another. Further features permit coupling or uncoupling an entire string of pipe without re-centering the tongs about the pipe string the so long as the greatest diameter of the pipe string is less then the diameter of the opening for surrounding pipe to be coupled or uncoupled. Also, multiple concentric strings of pipe my be coupled by providing the appropriate size gripping elements in the master and slave chordal segments by coupling the smaller pipe then backing off the chordal segments, moving the larger pipe in a position over the smaller joint engaging the gripping elements with this larger pipe and coupling it to the same diameter pipe. The action is repeated until the inner and outer pipes have been appropriately coupled. In achieving the coupling of the different sizes of pipe, spacers may be used behind the gripping elements as well as the gripping elements may be changed so that the face of the gripping elements may be provided at a different angle for the particular pipe being engaged. The arrangement provides a quick release set screw to retain the gripping elements, with or without spacers, in the appropriate position on the chordal segments.

In the chain drive arrangement, the chordal segments are driven until they lock up against the pipe; then the chordal segments being part of the rotary table, the entire segments driven by the chain drive rotate with the rotary table to fully couple or uncouple the pipes. Since the toothed arc of the leading chordal segment will be rotated out of engagement with the chain across the cavities in the frames while the trailing chordal segment will vacate the region adjacent the frame cavity, two chain carriers are provided mounted from the rotary mechanism engage the chain drive, thus preventing lost tension on chain. Further, to keep tension on the chain, two spring loaded idler sprockets are provided in the travel path of the chain.

BRIEF DESCRIPTION OF DRAWINGS

FIG. 7 is a plan view of the tool engaging a small diameter pipe for coupling.

FIG. 8 is a plan view of the tool engaging a large pipe for coupling into the string.

FIG. 9 is a plan view of the tool engaging a small diameter pipe for uncoupling.

DESCRIPTION OF THE PREFERRED EMBODIMENT(S)

Figure 1:
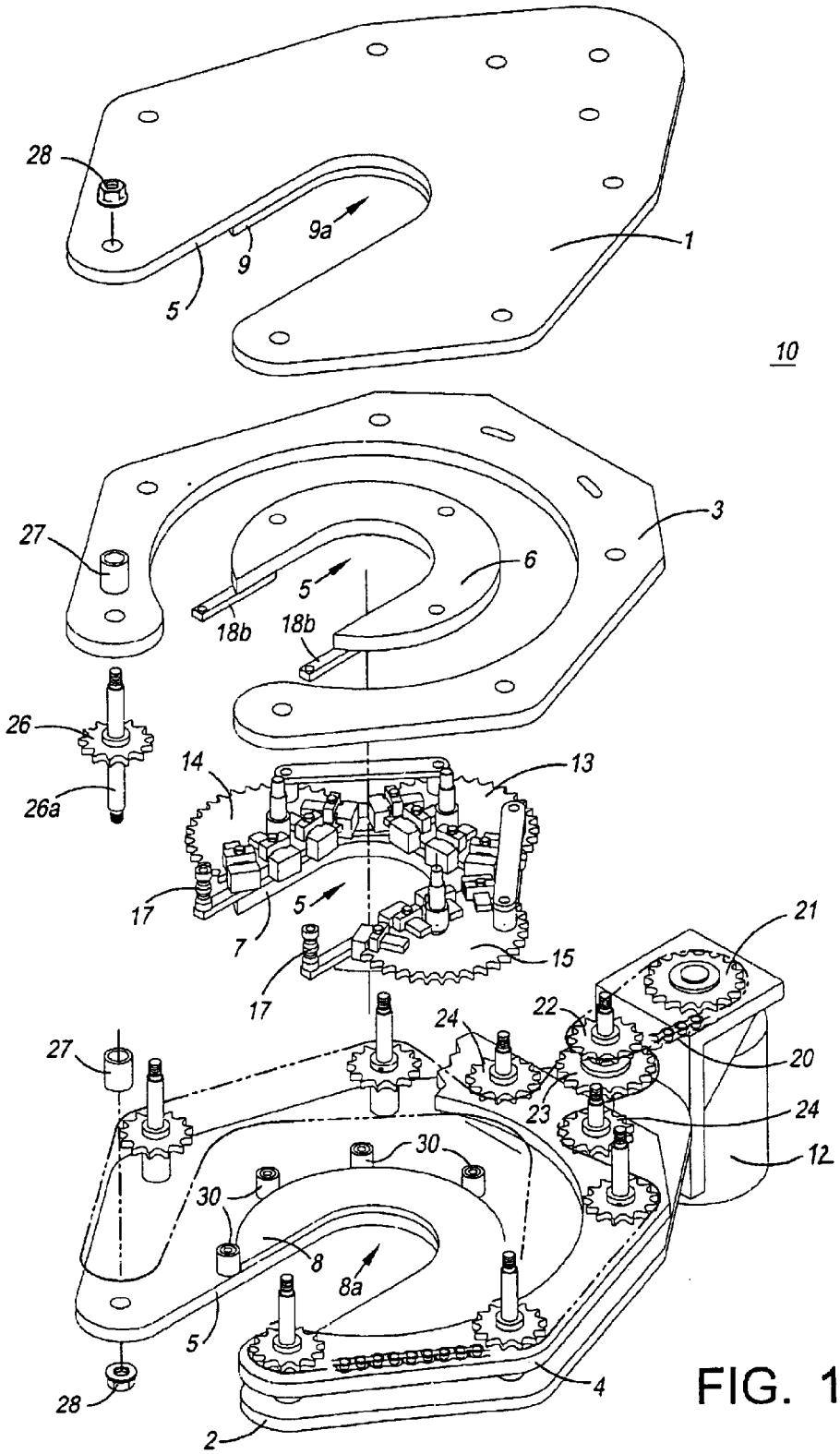
FIG. 1 is an exploded perspective view illustrating the major components of the tool.
Figure 2:
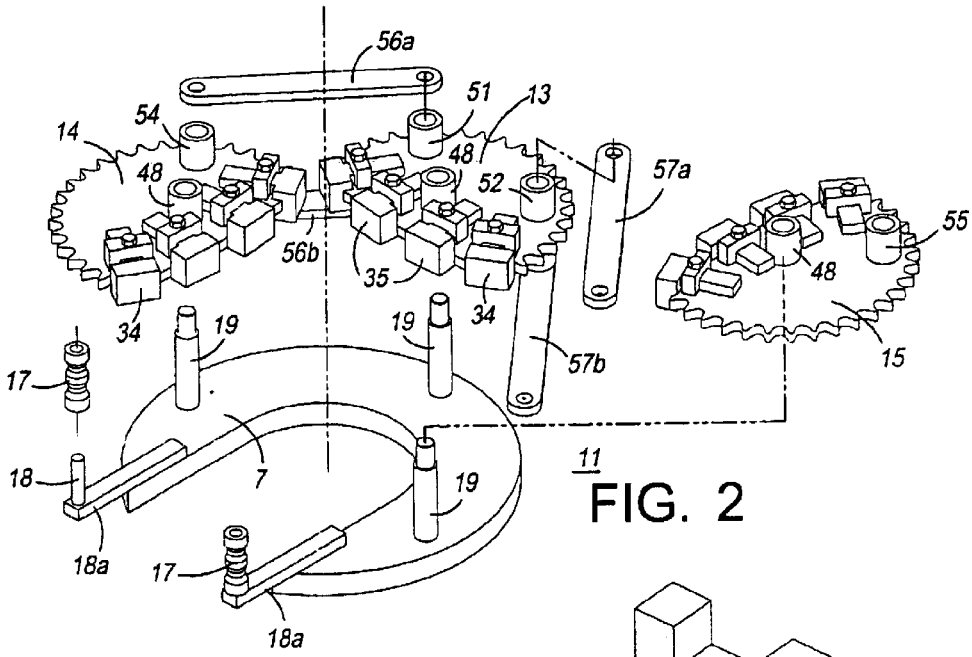
FIG. 2 is an exploded view in perspective partly showing the arrangement of the chordal segments and the rotary plates of the rotary mechanism.
Figure 3:
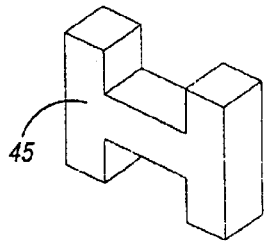
FIG. 3 is a perspective view of a spacer for adjusting the gripping elements.
Figure 4:
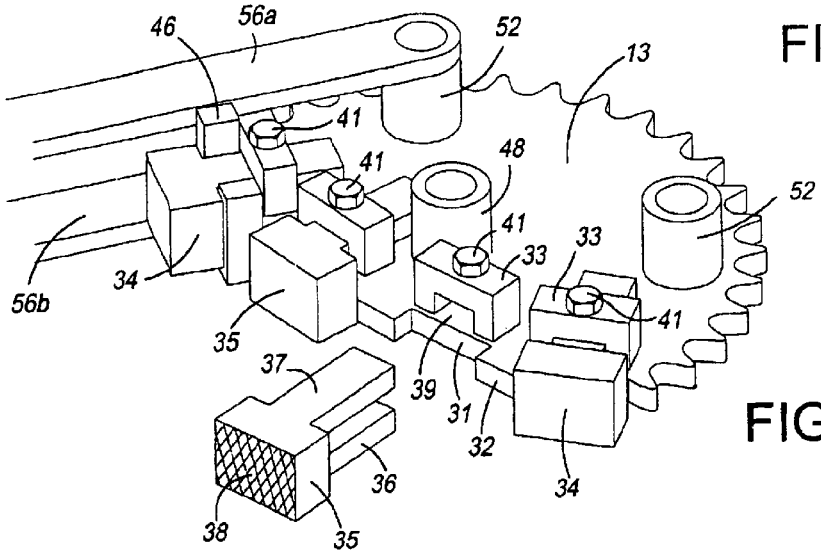
FIG. 4 is a perspective view of the master chordal segment illustrating the attachment of the bar linkage and back-off lug for realignment of the tool to engage or disengage a tubular member.
Figure 5:
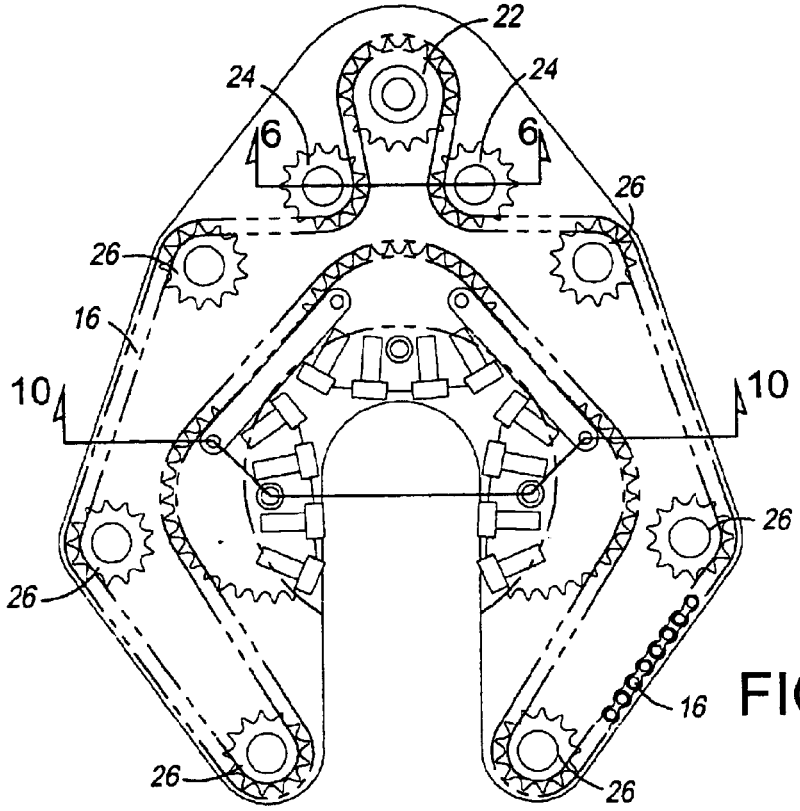
FIG. 5 is plan view illustrating the neutral position of the tool.
Figure 6:
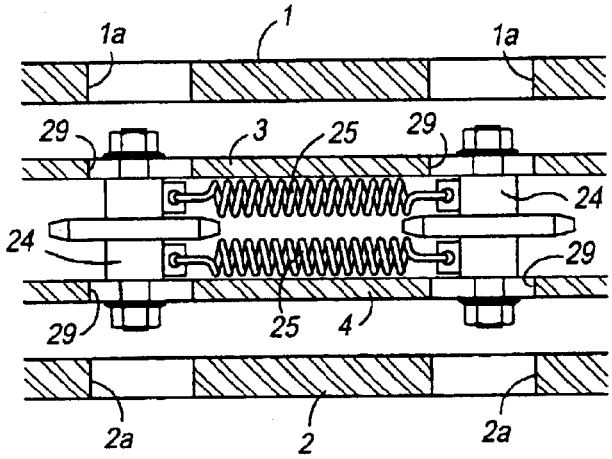
FIG. 6 is a sectional view taken along the lines 5—5 in FIG. 5 illustrating the spring biased sprockets.

Referring now to drawings and in particular to FIGS. 1 through 5, the description of the power tong generally referred to as 10 is described as the preferred embodiment of the invention. Power tong 10 includes top frame 1 and bottom frame 2, which houses the complete mechanism. Top frame 1 and bottom frame 2 are formed with u-shaped cavities 5, which are sufficient to permit centering pipe 43 or 44 within rotary mechanism 11. Wear plate 8 of circular design is seated on top of bottom frame 2 and has cavity 8*a* conforming to u-shaped cavity 5. Similarly, top frame 1 includes wear plate 9 similar to wear plate 8 with conforming cavity 9*a*. Positioned between top frame 1 and bottom frame 2 is upper stabilizing plate 3 and lower stabilizing plate 4. Top frame 1 and bottom frame 2 and upper stabilizing plate 3 and bottom stabilizing plate 4 are retained spaced apart by fixed spindles 26*a* secured between top frame 1 and bottom frame 2 through spacer bosses 27. Spindles 26*a* are secured to top frame 1 and bottom frame 2 by nuts 28. Sprockets 26 are journaled on spindles 26*a* to provide free rotation of sprockets 26. Surrounding wear plates 8 and 9 are flat back bearings 30 mounted on top plate 1 and bottom plate 2 maintain rotary plates 6 and 7 in proper position. Bottom rotary plate 7, best viewed in FIG. 2, has chain transport spindles 17 supported for rotation on rod 18 mounted from projection bar 18*a* on the upper side. Bottom rotary plate 7 has axles 19, which support for pivotal movement master chordal or gear segment 13 and slave chordal segments 14 and 15. Top rotary plate 6 best viewed in FIG. 1 is similar to bottom rotary plate 7 with projection bars 18*b* on the underside, which are seated over the ends of axle rods 18. Master chordal segments 13 and slave chordal segments 14 and 15 have recesses 31 along chordal borders 32. Housings 33 are spaced on master chordal and slave chordal segments 13, 14 and 15 adjacent recesses 31. Inner gripping elements 35 have prongs 36 and 37 extending behind face 38 of gripping elements 35. Each inner gripping element 35 is seated in recess 31 with prongs 36 below and 37 above the respective chordal segments secured in pass-through 39 in housing 33. Inner gripping elements 35 are secured by in recesses 31 set screws 41. H-shaped spacers 45 seat between prongs 36 and 37 and conform to the size of inner gripping elements 35. Outer gripping elements 34 are the same as inner gripping elements 35 except designed to engage smaller diameter tubes or pipes.

Figure 10:
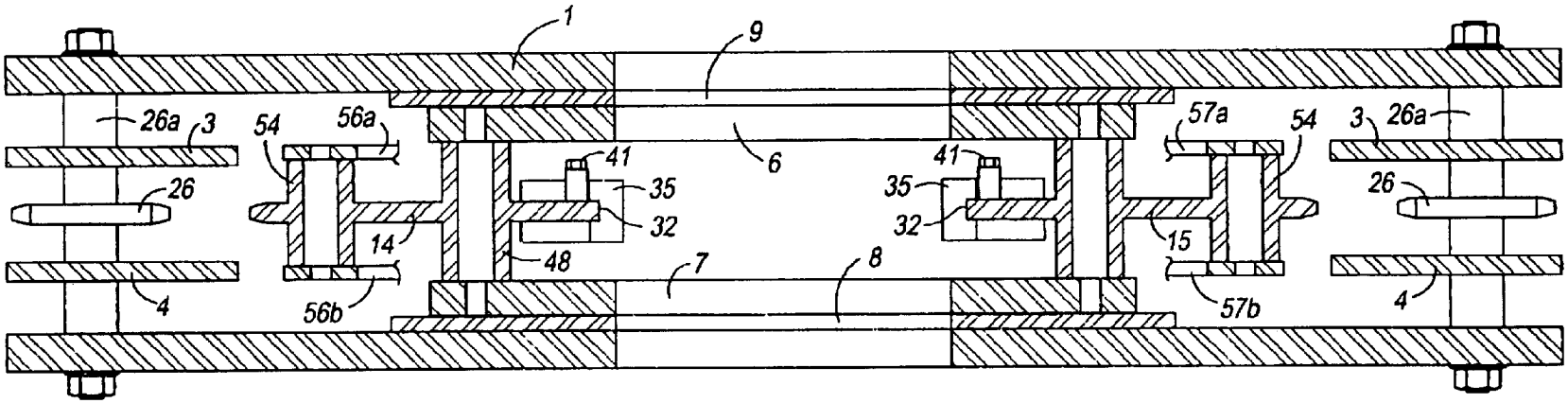
FIG. 10 is a cross-sectional view taken along lines 10—10 of FIG. 5.

Master chordal segment 13 and slave chordal segments 14 and 15 have mounting bosses 48, which are journaled on axles 19 for pivotal movements. Master chordal segment 13 has link bosses 51 and 52. Slave chordal segment 14 has link boss 54 and slave chordal segment 15 has link boss 55. Each of bosses 51 and 52 on master chordal segment 13 extend above and below master chordal segment 13. Similarly, link boss 54 on slave chordal segment 14 and link boss 55 on slave chordal segment 15 extend above and below the respective chordal segments as best seen in FIG. 10. Link boss 51 on master chordal segment 13 is coupled by link bar 56*a* and link bar 56*b* to link boss 54 on slave chordal segment 14. Similarly, link boss 52 on master chordal segment 13 is coupled by link bar 57*a* and link bar 57*b* to link boss 55 on slave chordal segment 15. With this linkage arrangement, the pivoting of master chordal segment 13 and slave chordal segments 14 and 15 are caused to pivot synchronously on their respective mounting bosses 48. With this linkage, there is no lead or lag in the positioning of outer or inner gripping elements 34 or 35 when engaging pipe 43 or 44. Further, the linkage maintains gripping elements 34 or 35 of chordal segments 13, 14 and 15 engaged with pipe 43 or 44 even when chordal segment 13, 14 or 15 disengage from chain drive 16. Likewise, after outer or inner gripping elements 34 or 35 have engaged pipe 43 or 44 and rotary mechanism 11 begins rotating counter-clockwise with master chordal segment 13 and slave chordal segments 14 and 15 and the pipe 43 or 44, slave chordal segment 14 begins disengaging from chain drive 16. Thus, when unthreading pipe 43 or 44 from the pipe string, slave chordal segment 14 continues to move across cavities 5 or top frame 1 and bottom frame 2, disengaging from chain drive 16. Then chain transports 17 follows slave chordal segment 15 and engages chain drive 16. Master chordal segment 13 rotates to the position of where slave chordal segment 14 begins to depart chain drive 16. At this point chain transport 17 is engaging chain drive 16 in the location being vacated by slave chordal segment 15. Thus it would be observed that chain drive 16 is maintained in engagement with either all three of chordal segments 13, 14 and 15 or two chordal segments and chains transports 17. With this arrangement the two bias sprockets 24, with springs 25 attaching them together for movement in slots 29 in upper and lower stabilizing plates 3 and 4, respectively, along with chain transports 17 maintain chain drive 16 under tension to prevent disengagement of chain drive 16 and failure of power tong 10 to continue rotating the pipe. Hydraulic motor 12 is mounted from bottom frame 2 and power tong 10 may be suitably mounted from a pick-up truck or any mobile crier. Hydraulic motor 12 rotates drive sprocket 21, which is linked to slave sprocket 22 by power chain 20, which in turn rotates transfer sprocket 23. As transfer sprocket 23 rotates chain drive 16 pivots chordal segments 13, 14 and 15 and then rotates rotary mechanism 11 to couple or uncouple pipe 43 or 44 as desired.

In operation to couple pipe or tube 43 into a tubing string of two concentric pipes, outer pipe 44 and inner pipe 43, gripping elements 34 for coupling inner pipe 43 only is necessary and the gripping element 34 for uncoupling inner pipe 43, if interfering, may be removed from the chordal segment. Both the coupling and uncoupling gripping element 35 for the outer pipe or tube 44 are retained in the chordal segments 13, 14 and 15. By operation of hydraulic motor 12 turning chain drive 16, chordal segments 13, 14 and 15 are pivoted clockwise until inner tubing gripping elements 35 engage inner pipe 43 at which time the chordal segments 13, 14 and 15 lock up with rotary plates 6 and 7 causing rotation of rotary plates 6 and 7 until inner pipe 43 is completely coupled. Then the chordal segments 13, 14 and 15 are rotated counter-clockwise to disengage gripping elements 34 from the inner pipe 43. Next outer pipe 44 is positioned over inner pipe 43 and within tool 10. Then chordal segments 13, 14 and 15 are again rotated clockwise until gripping elements 35 engage outer pipe 44 at which time chordal segments 13, 14 and 15 lock up with the rotary plates 6 and 7 causing rotation of plates 6 and 7 until outer pipe 44 is completely coupled. As long as next pipe 44 of the tubing string can be lowered through U-shaped cavity 5, the additional sections of tubing string can be coupled without withdrawing tool 10 from around the tubing string. In order to realign U-shaped cavities 5 of tool 10, spacer 46 is positioned in recess 31 behind inner pipe 43 gripping element 34, projecting either above or below or both gripping element 34, chordal segments 13, 14 and 15 are pivoted counter-clockwise until spacer or stop pin 46 engages link bar 56*a* or 57*a* connecting chordal segments 13, 14 and 15 together. Upon spacer or stop pin 46 engaging the link bar 56*a* or 57*a*, rotary plates 6 and 7 may be rotated counter-clockwise until it reaches the neutral position with rotary plates 6 and 7 and cavities aligned with cavities 5 in the housing top frame 1 and bottom frame 2. At this point rotation is stopped and power tong 10 may be moved to accommodate engagement with another section of this or another tubing string, which is lowered in the casing or well cavity. The foregoing operation is performed until the entire tubing string has been uncoupled. For breaking down a tubing string, the reversed procedure is used from that just described. In such case, the gripping element 34 for coupling small inner tube 43 and spacer may be removed and the gripping element for coupling the outer tube 43 and spacer 35 would be positioned in the appropriate recess 31.

It will be understood that the above described preferred embodiment may be modified as to use gearing rather than the chain drive. Further, other modifications are possible without departing from the inventive apparatus, which is limited only by the appended claims.

What is claimed:

1. A power tong for coupling and uncoupling tubular members comprising:

(a) at least one rotary plate with a U-shaped cavity adapted to receive a tubular member coaxially with the rotary plate;

(b) a housing compatible with and supporting the rotary plate;

(c) three chordal segments each having a toothed arc and a chordal edge with multiple recesses;

(d) a gripping element supported in each of the multiple recesses for engagement with the tubular member;

(e) said chordal segments pivotally mounted on the rotary plate and spaced at equiradii, one segment centered at the base of the cavity on a diameter bisecting the cavity and the other two segments on opposed sides of the cavity each at an equiangular displacement exceeding ninety degrees from the one segment; and (f) a drive mechanism for pivoting the chordal segments until one of the gripping elements of each engage the tubular member and thereafter imparting rotation of the rotary plate with the chordal segments for coupling or uncoupling the tubular member from another held stationary.

2. The apparatus of claim 1 wherein the one segment is linked with the other two segments by straps to insure synchronous rotation of the three chordal segments.

3. The apparatus of claim 1 wherein the drive mechanism includes a chain engaging the toothed arc of each chordal segment driven by a motive power unit.

4. The apparatus of claim 3 wherein the motive power unit is a power hydraulic motor.

5. The apparatus of claim 1 wherein the gripping elements are adjustable to various diameter tubular members by insertion of spacers behind the gripping elements in the recesses.

6. The apparatus of claim 1 wherein the multiple recesses consist of two pairs of recesses, one of the pair supporting gripping elements for coupling and uncoupling one range of sizes of tubular members and the other of the pair supporting gripping elements for coupling and uncoupling a second range of sizes of tubular members.

7. The apparatus of claim 1 wherein tow rotary plates are spaced apart and retain the three chordal segments therebetween.

8. A power tong for coupling and uncoupling tubular members comprising:

(a) a housing for supporting a rotary mechanism with a cavity adapted to receive a tubular member coaxially with the rotary mechanism;

(b) three gear segments each having a toothed arc and chordal edge with at least two recesses;

(c) a gripping element supported in each of the two recesses for engagement with the tubular member;

(d) said chordal segments pivotally mounted on the rotary mechanism and spaced at equiradii, one segment centered at the base of the cavity and the other two segments on opposed sides of the cavity each at an equiangular displacement exceeding ninety degrees from the one segment; and (e) a drive mechanism mounted to the housing engaging the toothed arc of the gear segments to impart pivotal movement to the segments until engagement with the tubular member, then rotary movement to the rotary mechanism.

9. The apparatus of claim 8 wherein the one segment is linked with the other two segments by straps to insure synchronous rotation of the three chordal segments.

10. The apparatus of claim 8 wherein the drive mechanism includes a chain engaging the toothed arc of each segment driven by a motive power unit.

11. The apparatus of claim 10 wherein the motive power unit is a power hydraulic motor.

12. The apparatus of claim 8 wherein the gripping elements are adjustable to various diameter tubular members by insertion of spacers behind the gripping elements in the recesses.

13. The apparatus of claim 8 wherein the multiple recesses consist of two pairs of recesses, one of the pair supporting gripping elements for coupling and uncoupling one range of sizes of tubular members and the other of the pair supporting gripping elements for coupling and uncoupling a second range of sizes of tubular members.

14. A power tong for coupling and uncoupling tubular members comprising:

(a) a rotary framework with a U-shaped cavity adapted to receive a tubular member coaxially with the rotary framework;

(b) a housing compatible with and supporting the framework;

(c) three chordal segments each having a toothed arc and a chordal border with multiple recesses;

(d) a gripping element supported in each of the multiple recesses for engagement with the tubular member;

(e) said chordal segments pivotally mounted from the rotary framework and spaced at equiradii, one segment centered at the base of the cavity on a diameter bisecting the cavity and the other two segments on opposed sides of the cavity each at an equiangular displacement exceeding ninety degrees from the one segment; and (f) a drive mechanism for pivoting the chordal segments until one of the gripping elements of each engage the tubular member and thereafter imparting rotation of the entire rotary framework with the chordal segments for coupling or uncoupling the tubular member from another held stationary.

15. The apparatus of claim 14 wherein the multiple recesses consist of two pairs of recesses, one of the pair supporting gripping elements for coupling and uncoupling one range of sizes of tubular members and the other of the pair supporting gripping elements for coupling and uncoupling a second range of sizes of tubular members.

* * * * *